US007169010B1

(12) United States Patent
Espinosa, Jr.

(10) Patent No.: US 7,169,010 B1
(45) Date of Patent: Jan. 30, 2007

(54) BLOCK AND GAVEL WITH THE INTENTION TO RELIEVE STRESS NOVELTY-KIT

(76) Inventor: Enrique Espinosa, Jr., 783 5th Ave., Chula Vista, CA (US) 91910

( * ) Notice: Subject to any disclaimer, the term of this patent is extended or adjusted under 35 U.S.C. 154(b) by 166 days.

(21) Appl. No.: 11/107,937

(22) Filed: Apr. 18, 2005

(51) Int. Cl.
*A63H 33/08* (2006.01)
*A63H 33/04* (2006.01)

(52) U.S. Cl. ..... 446/418; 446/78; 273/157 R; 434/403

(58) Field of Classification Search ..... 273/156, 273/440, 157 R; 434/159, 212, 403; 446/1, 446/5, 73, 75–77
See application file for complete search history.

(56) References Cited

U.S. PATENT DOCUMENTS 3,410,021 A * 11/1968 Patterson ..... 446/78
4,021,939 A * 5/1977 May ..... 434/403
4,037,846 A * 7/1977 Zeeman ..... 273/157 R
4,071,245 A 1/1978 Kendrick
4,094,510 A 6/1978 Drohomirecky
4,177,993 A * 12/1979 Crosby et al. ..... 273/160
4,319,751 A 3/1982 Kurushima
D294,181 S 2/1988 Romero
D334,127 S 3/1993 Nellis
5,435,565 A 7/1995 Benaderet
5,487,668 A * 1/1996 Oyen et al. ..... 434/98
5,752,701 A 5/1998 Kao
5,833,465 A 11/1998 Jarzewiak

* cited by examiner

*Primary Examiner*—Nini F. Legesse

(57) ABSTRACT

A simulated Judge's traditional courtroom gavel appartatus, comprising a sounding-block modified with a preferred plurality of nine cubes, bearing some fifty-four different graphic indicia (one upon each facet), a possibly stressful-situation sensitive word reading for example: "landlord", "boss", "step-mom", "taxes", "job", "school", "lawyer", "car." The user thus chooses the desired subject/topic from an assortment of cube selections held within the gavel-housing, then places that selected cube choice face-up into a holding-well formed down into the housing. The user may pause to reflect upon the stressful nature of the subject at hand (ie—"alimony"), —then picking-up the gavel, raises it well above the stressful-word held clearly exposed within the well, and while focusing directly thereto, slams the gavel resoundingly thereupon! This action may obstensibly soothe one's psyche of excess anger or frustration toward that person or object. A more compact generic-variant sets forth the alternative use of interchangeable tile-cards, similarly bearing the different topic words; either iteration offering user the option of subject write-in spaces as well.

6 Claims, 1 Drawing Sheet

EYE-VIEW REF.
CAR REPAIR
TOOTH ACHE
MY BOSS

BLOCK AND GAVEL WITH THE INTENTION TO RELIEVE STRESS NOVELTY-KIT

1.) BACKGROUND OF THE INVENTION

1. Field of Invention:

This invention relates to relates to stress relieving novelty devices and more specifically it relates to a plurality of cubes and a conventional judge's gavel and associated sounding block apparatus.

2. Relevant Prior-Art:

Background research discovery provides some prior patent-art regarded as germane to this disclosure, chronologically for example U.S. Pat. No. 4,094,510 (filed: November 1976) shows a "Tell it to the Judge game" which employs a gameboard involving a succession of player moves, however employs no judge's gavel & sounding-block apparatus.

In U.S. Pat. No. 4,071,245 (filed: February 1977) is shown a special gameboard having a plurality of square-recesses wherein are placed one of the several cubes each bearing different graphic-indicia upon its six facets. However, no Judge's gavel is employed in conjunction with the apparatus.

In U.S. Pat. No. 4,319,751 (filed: May 1980 from Japan) is shown a so called "Hammergame" which includes two opposing android (R2D2) looking manikins which are both separately operated by manual pushbuttons. They have a mallet in one arm and a shield in the other arm and the opposing human-players are to challenge each other to see which can knock-off the head of the other's android first. However, there is no graphic-indicia bearing cubes involved in the procedure.

In U.S. Pat. No. D-294,181 (filed: May 1986) is shown a "smoker's deterrent judge's gavel and sounding-block with ashtray"—apparatus; however, there are no graphic-indicia bearing cubes involved with the assembly.

In U.S. Pat. No. D-334,127 (filed: January 1991) is shown a special design for a gavel, which in an ordinary handle having a conventional lightbulb appearing mallet-head portion thereto; and no other members are included thereto.

In U.S. Pat. No. 5,435,565 (filed: July 1994) is shown a "boardgame relating to stress", which begins with a spiraling pathway of incrememntal moving-squares (not recessed), leading to a peaceful central place absent of problems and stress. However, there are no graphic-indicia bearing stress-relief cubes (only two dice), just six cylindrical marker-pieces (representing medicine-bottles); and no judge's gavel apparatus.

In U.S. Pat. No. 5,752,701 (filed: April 1997 from Taiwan) is shown a game apparatus having a planar-platen wherein are included a plurality of (at least two and preferably nine) recesses for receiving either a cube, a cylinder, or a triangular block; which have different graphic-numerals thereon, and are used in cooperation with an insert-card bearing graphic-indicia (which appear from beneath the recesses) of different numerical value (from 1–8). The object of the game being to play it in Bingo like fashion, random numbers being drawn from a bag and called outloud; hence, players endeavor by chance to be the first to arrange their marker-pieces into a predetermined design. However, there are only numbers borne upon the marker-pieces, and there is no judge's gavel included.

In U.S. Pat. No. 5,833,465 (filed: November 1997) is shown a plurality of cubical playing-blocks, bearing a character of the alphabet upon at least on facet thereof; plus, there are male/female type fittings provided upon interfacing surfaces, enabling the blocks to be strung together to form the alphabet or words. However, there is no contemplation of including a judge's gavel therewith.

Therefore, in full consideration of the preceding patent review, there is determined a need for an improved form of device to which these patents have been largely addressed. The instant inventor hereof believes their newly improved device with the intention to relieve stress apparatus, commercially referred to as the SLAM-A-GAVEL™, currently being developed for production under auspices of Whap'O-Mkg./Mkt.Co., —exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this invention is to provide a preferably realistic appearing judge's gavel (preferably having a lathe-turned wooden handle secured to a lathe-turned wooden mallet head) and associated parallelepiped sounding-block; with the notion and intention of it's user being able to obstensibly dispel some pent-up stress, which perhaps and possibly be relieved by the simple expedient of exorcising an appropriate word or symbol pertaining to a particular stressful situation they may be experiencing during the day.

For example, a junior-executive may be having a stressful encounter at work with their immediate superior;—thus to let off steam so to speak, the Jr.-executive can simply look to their desk-top SLAM-A-GAVEL™, and selecting from among the different headings borne upon the faces or facets of the various cubes (or reference cards) provided with the apparatus, insert the selected cube (or reference-card) wording or symbol (henceforth referred to as graphic-indicia) upturned into it's receptacle, and proceed to strike that graphic-indicia with whatever degree of physical force they feel appropriate to maybe relieve the emotional-stress being experienced,—and hence possibly being thereby psycho-physiologically excorcised at hand!

B.) Another object of this invention disclosure is to set forth an article according to proceeding item-A, wherein one iteration is provided a plurality of reference-cubes of identical size each, and provided with a method by which to exhibit a different graphic-indicia upon one of its six facets. The cubes may be actually furnished with blank faces or facets (or perhaps only some of the facets are factory applied graphic-indicia) whereby the user is thus furnished with a die-cut peelable, avulsable sheet (preferably of the type having a pressure-sensitive adhesive backing with a peel-away protective substrate) imprinted with perhaps a hundred different words, from which the user is to choose those words they feel seem most appropriate to their life situations.

For example, if the user of this invention deals a lot with the public, they may tend to need graphic-indicia label wordings more depicting stresses owing to the vicissitudes of public foibles; or, if the user deals more with governmental-agency bureaucrats such as the IRS, they may choose other words or phrases more akin to the frustrations of dealing with balky paperwork. Hence, if the novelty-kit hereof is so equipped, the user can via selective use of self-installed labeling, virtually customize the cube graphic-indicia to their own preference. Although it is preferred that the cube facets be factory-finished with various graphic-indicia such as may be neatly applied via the well known commercial silk-screen process; still another, albeit less attractive, is to furnish an ordinary grease-pencil or marker-pen with the novelty-kit, whereby the user may simply write their particular stress-relief wording upon a blank facet (shiny or matte finish surface) of the cube to be resoundly struck by the hand-held gavel.

C.) Another object of this invention disclosureis to set forth an article according to proceeding items-A&B, wherein the preferably parallelepiped gaveling sounding-block itself can be made of wood or plastic in several possibly preferred forms, as:

a.) a rigid structural configuration having a substantially flat upper-surface for sustaining downward thrust of the gavel and including a storage receptacle portion recessed within the framework of the upper-surface capable of holding an aggregation of preferably eight removable reference-cubes; plus a target-receptacle portion preferably formed centrally therein said upper-surface capable of holding a ninth reference-cube for upwardly exhibiting selected one of preferably fifty-four different graphic-indicias;

b.) a rigid structure having a substantially flat upper-surface cover lid of a squared equal sided configuration capable of withstanding thrust of gavel, including a target-receptacle portion arranged centrally therein, preferably with sidewalls extending vertically down contiguously into a lower storage receptacle portion preferably capable of holding eight reference-cubes around the submerged target-receptacle;

c.) a rigid structural configuration having a substantially flat upper-surface portion employing a central vue-window portion capable of sustaining repeated downward thrusts of the gavel, including a storage-receptacle portion thereunder capable of holding a removable plurality of user interchangable reference-cards, whereby selected indicia insription upon the uppermost stacked card is exhibited through the vue-window;

III.) DESCRIPTION OF THE PREFERRED EMBODIMENT DRAWINGS

The foregoing and still other objects of this invention will become fully apparent, along with the various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference drawings, which are considered as primarily exemplary and not to be construed as restrictive in nature; wherein:

IV.) ITEMIZED NOMENCLATURE REFERENCES

Figures 1A, 1B, 2A, 2B, 3A, 3B:
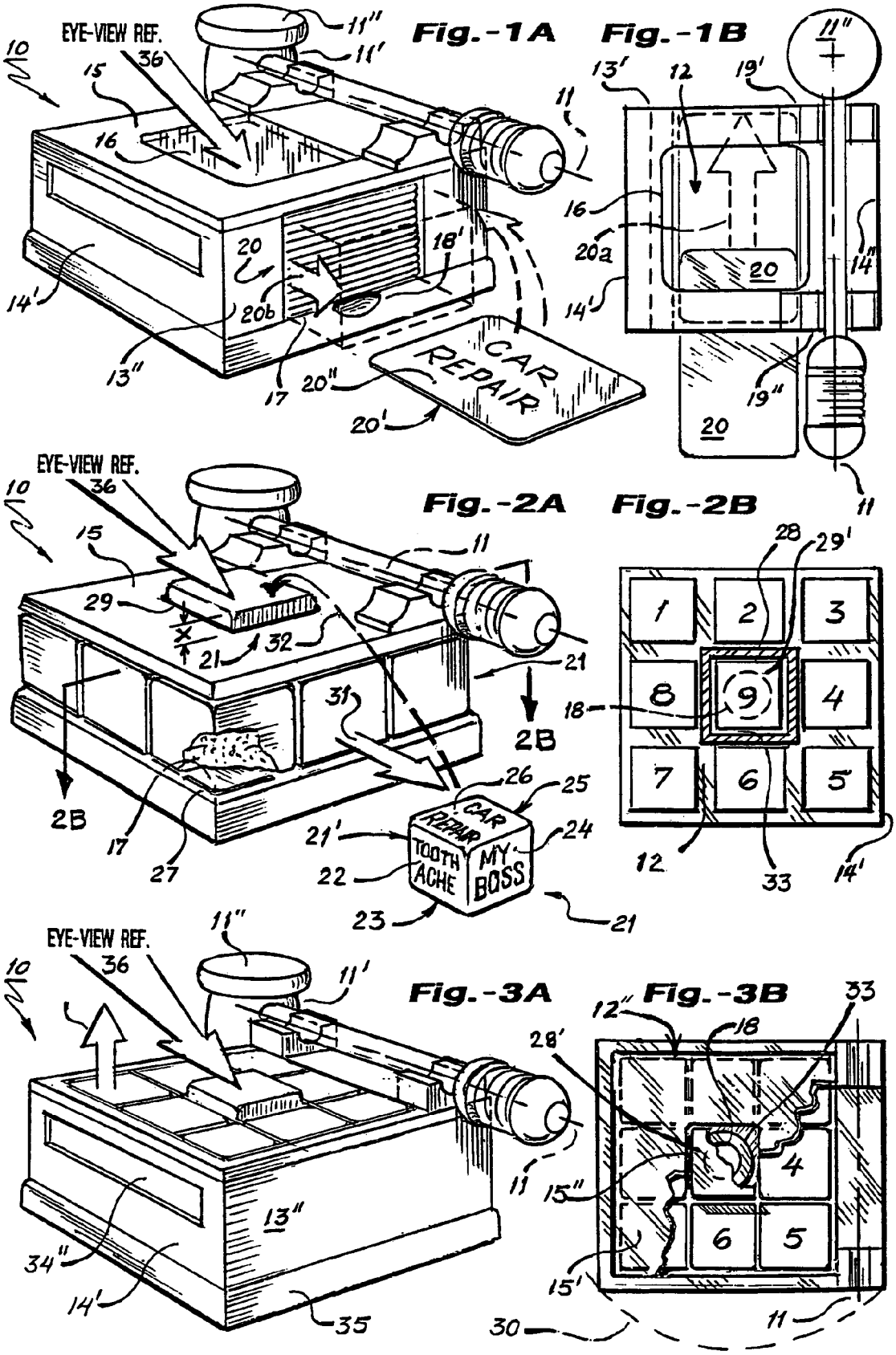
FIG.-1A, is a pictoral perspective-view, favoring the frontal upper-right corner portion thereof, and including a phantom-outline of the protuding reference-card array, plus a separated reference-card extending into the foreground.
FIG.-1B, is an upper/plan-view thereof, including a phantom-outline indicating the preferred stored position of the stacked reference cards.
FIG.-2A, is a pictoral perspective-view showing a generic-variant embodiment, favoring the frontal upper-right corner portion thereof and includes a partial cut-away of the foreground cube to better reveal the perimeter retention-bead.
FIG.-2B, is an upper/plan-view thereof, taken along reference plane 2B:2B in FIG.-2A, hence eliminating the upper-surface portion from this view.
FIG.-3A, is a pictoral perspective-view showing another generic-variant embodiment favoring the frontal upper-right corner portion thereof.
FIG.-3B, is an upper/plan-view thereof and including a partial cut-away of the covering lid to better reveal the underlaying cube array.

10—general receiver-housing
11/11'/11"—gavel (portions: handle-axis/head/head-face)
12/12'/12"—storage-receptacle (types: carded/cube peripheral-stow/cube top-stow)
13'/13"—lateral sidewalls (left/right)
14'/14"—sidewalls (front/rear)
15, 15', 15"—upper surface, upper surface lid, lid square-port
16—vue-window
17,17'—storage area, finger-tip access reliefs
18—finger ejection-hole
19'/19"—hanger-brackets (left/right)
20, 20'/20",20*a*/20*b*—stacked reference-cards, (1st-side/2nd-side), ref.-arrows(in/out)
21,21'—general reference-cubes, cube's 1st-face
22—reference-cube's 2nd-face
23—reference-cube's 3rd-face
24—reference-cube's 4th-face
25—reference-cube's 5th-face
26—reference-cube's 6th-face
27—perimeter retention-bead
28, 28'—vertical square-wall support, target receptacle area
29,29'—target-receptacle position, internal-cavity surfaces
30—optional rounded sidewall configuration
31—first-action ref.-arrow
32—second-action ref.-arrow
33—slightly elevated target-receptacle supporting-surface
34—product-identification label-recess
35—storage receptacle perimeter-edging
36—user's eye-view ref.-arrow

V.) DETAILED DESCRIPTION OF THE PREFERRED EMBODIMENTS

Initial reference is given by way of corresponding FIGS.-1A/1B, wherein is exhibited the version of my intention to relief-stress invention, here employing a plurality of stacked reference-cards 20 which are intimately stacked and manually inserted into the preferably parallelepiped sounding-block receiver housing 10 preferably via a laterally arranged storage-receptacle (preferably a through-portal) region 12, which is arranged within the left 13' and right 13" sidewalls and further encompassed by the front 14' and rear 14" sidewalls, and an upper-surface 15 having a contiguous vue-window 16 portion capable of withstanding the impact of the gavel head-face portion 11". The substantially conventionally styled judge's gavel is (preferably of lathe-turned hardwood trimmed with brass ferules, but injection-molded plastic is acceptable in economy versions), having a handle-axis portion 11 rigidly affixed to a head portion 11', and is normally supported atop of the receiver-housing 10 by laterally opposed pair of fixed hanger-brackets 19' and 19", each presenting a half-round cradle arrangement.

Notice also how the plural ref-cards stack 20 is shown being manually inserted in FIG.-1B (ref.-arrow 20*a*), and conversely manually withdrawn en'masse (ref.-arrow 20*b*) in FIG.-1A;—their sliding withdrawal thereby enabling the user to conveniently shuffle through the reference-cards in review of the numerous different graphic-indicia selections exhibited preferably upon both of any given ref.-card's first-side 20' and opposite second-side 20" (although some of the ref.-card sides may be left blank, allowing user to apply their own inscription if desired). Accordingly, the ref.-card graphic-indicia chosen by the user as being most appropriate to the situation of the moment, a probable graphic-indicia "CAR-REPAIR" for example, would thus be arranged atop the stack of ref.-cards, for subsequent sliding replacement 20*a*(action ref.-arrow) into the storage receptacle (or storage-chamber) 12. where it is held for optimal eye-view reference (depicted by ref.-arrow 36) as to be clearly read through vue-window 16 while the gavel head-face 11" is hammered resoundingly down toward the viewed image.

There remain subtle, however vital other differences which are to become herein more evident and understood as important improvements. For example, study of FIGS.-2A/2B and 3A/3B reveals generic-variant embodiments each preferably employing nine blocks (cubes) bearing a different graphic-indicia preferably upon each of their six sides (clearly exemplified as sides—21', 22, 23, 24, 25, 26 (in FIG.-2A), thereby potentially providing some fifty-four different legends thereon, although some of the ref.-block sides may be left blank, allowing the user to apply their own inscription if preferred. The preferred quantity of nine blocks was determined primarily by virtue of their orderly compact geometric layout, enabling the ninth-block "# 9" (in FIGS.-2B/3B) to be the one selected by the user as bearing the instantly most suitable graphic legend for upward orientation display within the preferred central target-receptacle position 27' (in FIGS.-2A/2B) and 27" (in FIGS.-3A/3B);—where it is preferably held slightly elevated (⅛th-¼-inch) for optimal impact and eye-view reference (as depicted by ref.-arrow 36 in FIG.-2A and ref.-arrow 36 in FIG.-3A), while the gavel head-face 11' is summarily hammered resoundingly upon the viewed image.

Further study of FIG.-2A shows how the ref.-cubes 21 are primarily gravity-supported within the perimeter confines of the receiver-housing's horizontal lower-storage area surface 17, where there is also preferably included a slight upwardly extending perimeter retention-bead 27 (about 1/16th-inch height and may be continuous or segmented) to thereby retentively curb the ref.-cubes within the receiver-housing when it is moved about;—yet not so aggressive a retention lip entity as to make extracting of the different ref.-cubes 21 excessively difficult when selecting one's desired graphic-indicia inscription. The rigid upper-surface 15 portion of the sounding-block is here formed as a squared overhanging structural configuration which fastens and holds together the ref.-cubes, whereto a target-receptacle portion indicated in FIG.-2B is preferably formed as a central vertically extending four-sided square-wall portion 28, extending rigidly upwardly from the underlying rigid storage-area surface 17;—thereby enabling the perimeter of this sounding-block to preferably appear entirely open to users lateral removal of any of the eight surrounding reference-cubes 1–8. Accordingly, the first-action ref.-arrow 31 of FIG.-2A indicates how the user extracts one or more ref.-cubes 21 to then manually rotate the ref.-cube 21 as to find the most suitable graphic-indicia legend inscribed thereon, then if "CAR REPAIR" is selected (for general example), the user exchanges the selected ref.-cube via second-action ref.-arrow 32 with the ninth ref.-cube occupying the target-receptacle position 29 (note that some may prefer to leave the position 29 empty until occasion arises for its use). The preferred square wall portion 28 thus being structurally capable of withstanding users downward impacts by the gavel; and hence, forming a parallelepiped cavity portion 29' there within, including a slightly elevated predetermined height surface 33 thereto. The elevated surface is seen in FIG.-2A where the ref.-cube block 21, held within the four sides 28 of the target receptacle, can be seen to extend vertically upward from the horizontal surrounding upper-surface 15 approximately ⅛-inch to ¼-inch, as is shown by the indicated dimension-"X" thereto. Note also, that although the greater vertical protuberance (dimension-X) can enable the user to grasp the upper edges of the ref.-cube 21, an optional finger accessible ejector-hole 18 can also be provided in the elevated target receptacle supporting-surface 33; thereby enabling the user to simply reach under the uplifted receiver-housing 10 and merely poke their finger upwardly through the ejector-hole 18; thereby urging the ref.-cube up and out of its holding target-receptacle 29'. The alternate arrangement suggested in FIG.-3A differs in that the receiver-housing sidewalls 13'/13" and 14'/14" (both lateral and front/rear) more closely resemble that of the FIG.-1A embodiment, but are made entirely solid from perimeter-base 31 region up to the uppermost perimeter-rim 32 portion. Although not revealed in FIG.-3A for sake of visual-clarity, FIG.-3B shows a preferred manually removable upper-surface lid 15' (made of flat wood or plastic) having a square-aperture lid square port 15" thereby facilitating easy access to the target-receptacle area 28". Here (in FIG.-3B), the target-receptacle area 28' is actually created by the surrounding juxtapositioning of the other eight ref.-cubes, yet it is still preferred that the optional finger ejection-hole 18 be comprised into the preferably included slightly elevated target-receptacle surface 33 within the floor surface portion of the storage area 17. It is also suggested in FIG.-3B how the sidewalls 13'/13" as well as sidewalls 14' and 14" may optionally be configured in a circular manner, as is indicated via the phantom-outline 30; although such a shape is considered to be less spatially efficient.

Thus, it is readily understood how the preferred and generic-variant embodiments of this invention contemplate performing functions in a novel way not to heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use which it is susceptible. Accordingly, the embodiments of the invention in which an exclusive property or proprietary privilege is claimed, are defined as follows.

What is claimed is:

1. An apparatus simulating a judge's gavel and block, for private individual mock use;

said apparatus comprising:

a gavel having a handle secured to a mallet head member;

a plurality of nine reference-cubes each having six facets; said reference-cubes being of identical size and each bearing a different graphic-indicia on one of said six facets;

a horizontally oriented four-sided storage area platen having a planar top surface; a target-receptacle is located centrally on said planar top surface of said storage area platen; eight of said reference-cubes being stored on said top surface of said storage area platen surrounding said target-receptacle; said target-receptacle having a bottom defined by a supporting wall surface that is elevated a predetermined height X above said top surface of said storage area platen so that when said ninth reference-cube is inserted into said target-receptacle it will extend above said eight reference-cubes stored on said top surface of said storage area platen; and said sequence of use of said apparatus begins when a user determines from among said six facets on said nine reference-cubes which graphic indicia they desire to address; the user then places said reference-cube bearing the selected graphic-indicia down into said target-receptacle with the selected graphic-indicia oriented upward to be ultimately struck by said gavel.

2. An apparatus as recited in claim 1 wherein said supporting wall surface in said target-receptacle has a finger ejection-hole that allows convenient entry of one's finger from beneath said storage area platen in order to manually eject said reference-cube upward from said target-receptacle.

3. An apparatus as recited in claim 1 further comprising an upper-platen panel having a square-port provided centrally therein for protruding exposure of said ninth reference-cube; said upper-platen panel being supported directly on eight of said reference cubes.

4. An apparatus as recited in claim 3 further comprising a pair of gavel hanger brackets mounted on said upper platen panel for receiving said gavel.

5. An apparatus as recited in claim 1 further comprising side walls extending upwardly from said four sides of said storage area platen to surround eight of said reference-cubes.

6. An apparatus as recited in claim 5 further comprising a pair of gavel hanger brackets mounted on at least one of said side walls.

* * * * *